US005349812A

United States Patent [19]

Taniguchi et al.

[11] Patent Number: 5,349,812

[45] Date of Patent: Sep. 27, 1994

[54] GAS TURBINE COMBUSTOR AND GAS TURBINE GENERATING APPARATUS

[75] Inventors: Masayuki Taniguchi; Hironobu Kobayashi, both of Katsuta; Kiyoshi Narato, Ibaraki; Tadayoshi Murakami, Hitachi; Shigeru Azuhata, Hitachi; Michio Kuroda, Hitachi; Noriyuki Hayashi, Hitachi, all of Japan

[73] Assignee: Hitachi, Ltd., Tokyo, Japan

[21] Appl. No.: 10,576

[22] Filed: Jan. 28, 1993

[30] Foreign Application Priority Data

Jan. 29, 1992 [JP] Japan ..... 4-013685

[51] Int. Cl.[5] ..... F02C 9/50

[52] U.S. Cl. ..... 60/39.23; 60/39.27; 60/747

[58] Field of Search ..... 60/39.23, 39.27, 29.39, 60/39.281, 747

[56] References Cited

U.S. PATENT DOCUMENTS

| | | | |
|---|---|---|---|
| 3,693,347 | 9/1972 | Kydd et al. | 60/39.05 |
| 4,408,461 | 10/1983 | Bruhwiler | 60/737 |
| 4,446,692 | 5/1984 | Adkins | 60/39.23 |
| 4,534,166 | 8/1985 | Kelm et al. | 60/39.23 |
| 5,016,443 | 5/1991 | Shimizu et al. | 60/39.23 |

FOREIGN PATENT DOCUMENTS

| | | |
|---|---|---|
| 61-52523 | 3/1986 | Japan . |
| 4-124520 | 4/1992 | Japan . |
| 4-131619 | 5/1992 | Japan . |
| 4-136603 | 5/1992 | Japan . |

*Primary Examiner*—Richard A. Bertsch
*Assistant Examiner*—William Wicker
*Attorney, Agent, or Firm*—Antonelli, Terry, Stout & Kraus

[57] ABSTRACT

A gas turbine combustor is capable of reducing NOx over a whole load range of a gas turbine. The combustor comprises two burner systems. It is possible to independently control a flow rate of combustion air supplied to a burner of the respective systems and a flow rate of bypass air jetted from through a bypass air port. The air supplied to the burners is mixed with fuel in a mixing chamber and then ejected into a combustion chamber so as to form a flame. The amount of bypass air is controlled in accordance with an operation load, a humidity of air and a heating value of fuel. It is therefore possible to prevent any blow off and reduce NOx over the whole load range of the gas turbine.

6 Claims, 10 Drawing Sheets

GAS TURBINE COMBUSTOR AND GAS TURBINE GENERATING APPARATUS

BACKGROUND OF THE INVENTION AND RELATED ART STATEMENT

The present invention relates to a gas turbine combustor and a gas turbine generating apparatus, and more particularly, to a low NOx gas turbine combustor and a low NOx gas turbine generating apparatus which are suitable to use gaseous fuel or liquid fuel.

One of the features of the gas turbine combustor is a very wide operation range from starting to full load. For the application of this wide operation range, it has conventionally been customary to operate the gas turbine combustor by regulating the amount of fuel supplied to burners with the amount of air kept constant as disclosed in Japanese Patent Unexamined Publication No. 61-52523. However, according to the operating method in which only the amount of fuel is regulated, when the load is low, the amount of fuel is reduced during the operation so that the combustion becomes lean on fuel to make it impossible to maintain a good combustion state, resulting in that unburned fuel is increased. To cope with this, it is proposed in Japanese Patent Unexamined Publication No. 61-52523 that, in order to maintain a good combustion state over the whole operation range of a gas turbine and reduce the emission of nitrogen oxides (NOx), a combustion chamber is divided into a primary stage combustion section in charge of the low load operation and a secondary combustion section in charge of the high load operation so as to effect the two-stage combustion and the amount of combustion air for the primary stage and the amount of combustion air for the secondary stage are made changeable independently. The primary stage combustion section adopts a diffusion combustion mode in which fuel and air supplied from different exhaust ports are mixed in the combustion section and combusted, while the secondary stage combustion section adopts a premixed combustion mode in which fuel and air are mixed prior to combustion.

In order to reduce the amount of NOx produced from the gas turbine combustor, it is effective to decrease the temperature of combustion gas. The temperature of combustion gas becomes lower as the amount of air becomes larger when the amount of fuel is kept constant. Namely, as the combustion becomes lean on fuel, the temperature of combustion gas becomes lower to make it possible to reduce NOx. However, in the case of a burner of the diffusion combustion type, even if the amount of air is increased to effect the combustion under the condition of lean on fuel, a region where an excess air ratio becomes close to 1 (one) inevitably appears in the process of mixing fuel and air in the combustion chamber. For this reason, it is difficult in general to reduce NOx and the merit of controlling the amount of air is not so great for the reduction of NOx. On the other hand, in the premixed combustion burner, the NOx emission can be reduced by performing the fuel lean combustion. However, for the fuel lean combustion, it is necessary to keep the fuel-air ratio within a specified range that results in the low NOx emission even if the load of the turbine is changed.

In the above-described prior art, no suggestion is made about the means for keeping the fuel-air ratio within a specified range that results in the low NOx emission even if the load of the turbine is changed.

OBJECT AND SUMMARY OF THE INVENTION

An object of the present invention is to provide a gas turbine combustor and a gas turbine generating apparatus, which are capable of reducing the NOx emission over the whole operation range of the gas turbine from starting to full load.

To this end, according to the present invention, there is provided a gas turbine combustor which comprises a combustion chamber, a plurality of premixed flame burners disposed in the combustion chamber, in which fuel and air are premixed prior to combustion, means for supplying fuel to the burners, means for controlling an amount of fuel to be supplied to the burners, means for supplying combustion air to the burners, dilution air port means provided downstream of the burners, and means for controlling an amount of air supplied to the burners and an amount of air injected from through the dilution air port means in accordance with a change of the amount of fuel to be supplied to the burners. It is desirable that the amount of air supplied to the premixed flame burner and the amount of air injected through the dilution air port means are controlled in response to a change of the amount of fuel to be supplied to the burners. Since the amount of fuel supplied to the burners is changed in accordance with a change of the turbine load, it is also possible to control the amount of air in response to the load of the turbine. Fuel may be gaseous or liquid, and examples of gaseous fuel include LNG, LPG and town gas while examples of liquid fuel include methanol, naphtha, ethanol, kerosene and light oil.

It is desired that the above-described burners have at least two systems of burners including a primary stage combustion burner means in charge of the starting operation, or the starting and low load operations, and a secondary stage combustion burner means in charge of the high load operation which cannot be managed by the primary stage combustion burner means. It is desirable that the primary stage combustion burner means is disposed in the combustion chamber substantially in a central portion thereof and the secondary stage combustion burner means is disposed around the primary stage combustion burner means so as to surround the same. The primary stage combustion burner means may be a pilot burner.

It is desired that the secondary stage combustion burner means includes a plurality of combustion burners disposed around the primary stage combustion burner means or an annular combustion burner disposed to surround the primary stage combustion burner means.

By locating the forward ends of the primary and secondary stage combustion burner means substantially on the same plane, it is possible to transfer a flame from the primary stage combustion burner means to the secondary stage combustion burner means without providing any ignition burner.

The gas turbine combustor of the present invention may be a combustor of the structure that the primary stage combustion burner means is disposed in the combustion chamber on the upstream side thereof and the secondary stage combustion burner means is disposed on the downstream side of the primary stage combustion burner means.

The primary stage combustion burner means or the secondary stage combustion burner means may be a burner of the type that can change the combustion mode between a diffusion combustion mode in which fuel and air supplied from different exhaust ports are mixed and combusted, and a premixed combustion mode in which fuel and air are premixed prior to combustion. By so doing, it becomes possible to prevent the blow off of a flame by adopting the diffusion combustion mode at the time of starting or when the load is low as well as to reduce NOx by changing to the premixed combustion mode when the load is high.

In the combustor of the present invention, it is desired that, if the amount of fuel supplied to the premixed flame burner is changed in accordance with a change of the load of the turbine, the amount of air supplied to the same burner is changed correspondingly thereto so as to maintain the excess air ratio of the burner in a specified range constantly even if the fuel supply amount is changed. Accordingly it becomes possible to obtain a low NOx combustion. The excess air ratio of the burner is represented by the ratio of the amount of inflow air to the amount of air theoretically required for complete combustion, and it is preferred to maintain this ratio in the range between 1.6 and 1.8.

It is desired that each of the burner air amount control means and the dilution air amount control means has an air swirl type structure in which controllable pitch swirler vanes, an angle of each of which is changeable, are provided so as to regulate the air flow rate by changing the angle of the vanes. By so doing, it is possible to quickly change the amount of air to a specified amount.

In the gas turbine combustor of the present invention, it is desired that the amount of air injected through the dilution air port means is controlled in accordance with not only the change of the amount of air supplied to the burner due to the change of the amount of fuel supplied to the burner, but also the change of the heating value of fuel and/or the humidity of combustion air. Further, it is desirable that each burner in the combustor is provided with a flame holding means including a flow resistance member against which a jet of mixture of fuel and air collides. By so doing, it is possible to control the blow off of a flame at the time of the premixed combustion.

In addition, it is desired that the primary stage combustion burner means is provided with means for injecting fuel from inside of the flow resistance member.

On the other hand, according to the present invention, there is provided a gas turbine generating apparatus which comprises a combustor which is provided in a combustion chamber thereof with a plurality of burners of the premixed combustion type in which fuel and air are mixed beforehand prior to combustion and dilution air port means disposed downstream of the burners, a compressor for compressing air to be supplied into the combustor, a turbine driven by combustion gas produced in the combustor, an electric generator driven by the power obtained by the turbine, means for controlling the amount of fuel supplied to the burners in the combustor in accordance with a change of load of the turbine, means for controlling the amount of air supplied to the burners in accordance with a change of the amount of fuel so as to maintain the excess air ratio of the burner within a specified range, and means for controlling the amount of air injected from through the dilution air port means in response to a change of the amount of air supplied to the burners.

Further, there is provided a gas turbine generating apparatus which comprises a combustor which is provided in a combustion chamber thereof with a plurality of burners of the premixed combustion type in which fuel and air are mixed beforehand prior to combustion and with dilution air port means disposed downstream side of the burners, a compressor for compressing air to be supplied to the combustor, a turbine driven by combustion gas produced in the combustor, an electric generator driven by the power obtained by the turbine, a control unit sending a control command to the combustor in response to a change of load of the turbine, means for controlling an amount of fuel supplied to the burner in the combustor in accordance with the control command from the control unit, means for changing an amount of air in accordance with a change of the amount of fuel supplied to the burner so as to maintain an excess air ratio in a specified range, means for controlling the amount of air injected from through the dilution air port means in response to a change of the amount of air supplied to the burner, and a display disposed in the control unit, which indicates the controlled variable of the burner air amount control means, the turbine load, the amount of fuel supplied to the burners and/or the fuel control conditions in the combustor.

It is desired that the control unit is implemented with a program in which the turbine load, and the controlled variable of the burner air amount control means and/or the controlled variable of the dilution air amount control means are correlated with one another so as to control the burner air amount control means and the dilution air amount control means in accordance with this program.

Further, it is desired that the control unit is further implemented with a program in which the turbine load and the controlled variable of the burner fuel supply amount control means are correlated with each other.

It is desirable that the control unit is provided with a display which indicates the controlled variable of the burner air amount control means, the turbine load, and the amount of fuel supplied to the burners and/or the fuel control conditions in the combustor, so as to control the amount of air or the amount of fuel to be supplied to the burners by judging whether or not the amount of air or the amount of fuel to be supplied to the burners is proper based on the data indicated on the display.

It is desired that the control unit is further provided with a display which indicates the heating value of fuel and/or the humidity of combustion air, so as to make a supplemental control on the air flow rate of the dilution air port means of the combustor based on the heating value of fuel and/or the humidity of combustion air indicated on the display.

At least two systems of premixed flame burners including the primary stage combustion burner and the secondary stage combustion burner are disposed in the combustor, the dilution air port means is disposed downstream of the burners in the combustor, and the amount of air supplied to the burner of each system and the amount of air supplied to the dilution air port means can be controlled independently. Therefore, at the time of the cross fire from the primary stage combustion burner to the secondary stage combustion burner, by increasing the amount of dilution air and decreasing the amount of combustion air, it is possible to prevent the blow off of the flame. Further, at the time of the high load operation, the dilution air port means is closed to allow almost all of air flowing into the combustor to be used as combustion air, and therefore, combustion can be performed when the fuel is sufficiently lean for the reduction of NOx.

Further, by providing the flame holding means on each burner for stabilizing the flame, it is possible to further prevent the blow off of the flame.

It is desired that, in order to improve the ignitability at the time of starting of the combustor, the primary stage combustion burner is a burner of the type that can change the combustion mode between the diffusion combustion mode and the premixed combustion mode and is operated in the diffusion combustion mode at the time of starting.

In order to reduce the NOx emission when the load of the gas turbine is low, particularly on the cross fire, it is effective to dispose the burners of two systems substantially on the same plane. At the time of the cross fire, in order to prevent the blow off of the flame of the burner used for the low load operation, it is necessary temporarily set the excess air ratio of this burner nearly at the equivalent fuel-air ratio. In this case, NOx is easily emitted. By disposing the burners of two systems substantially on the same plane, fuel in the flame of the burner for low load operation can be reduced with air ejected from the burner for high load operation, thereby making it possible to reduce the NOx emission on the cross fire.

Specifically, it is preferred that the mechanism for stabilizing the flame is formed by the flow resistance member provided inside of a jet of air or of mixture of fuel and air, which is ejected from the outlet port of the burner.

Further, it is preferred, specifically, that the mechanism for controlling the amount of air supplied to the burner or the dilution air port means is constituted by the controllable pitch swirler vanes which are provided at each air inlet port and a pitching angle of each of which is changeable, particularly by a slide ring provided at each air inlet port.

In order to further improve the flame stability of the premixed flame burner, it is effective to provide, as the mechanism for holding the flame, a flow resistance member against which a jet of air or of mixture of fuel and air ejected from the burner outlet port collides, and to provide a mechanism for ejecting fuel from inside of the flow resistance member in the premixed flame burner. By ejecting fuel from inside of the flow resistance member, a fuel rich zone is formed locally in the flame. Therefore, it is possible to form a stable flame even if the average fuel concentration exceeds the lean limit of inflammability. Particularly, by providing the mechanism for ejecting fuel from inside of the flow resistance member in the primary stage combustion burner, it is possible to prevent the blow off on the cross fire.

When the humidity of air is high or when the heating value of fuel is low, it is possible to reduce the NOx emission even if the amount of combustion air is small, but the flame is easily blown off. On the other hand, when the humidity of air is low or when the heating value of fuel is high, it is difficult for the flame to be blown off but it is necessary to increase the amount of combustion air in order to reduce the NOx emission. For this reason, by providing a mechanism for measuring the humidity of combustion air and changing the amount of air injected from through the dilution air port means in accordance with a change of the air humidity, or a mechanism for measuring the heating value of fuel and changing the amount of air injected from through the dilution air port means in accordance with a change of the heating value, it is possible to maintain an optimum amount of combustion air even if the humidity or the heating value is changed. It is desirable to obtain beforehand how the heating value of fuel and/or the humidity of combustion air changes throughout one year and prepare a program in which the resultant change of the amount of air passed through the dilution air port is set beforehand. By changing the amount of air injected from through the dilution air port means in accordance with this program, it becomes sufficient only to control the amount of air injected from through the dilution air port means in response to a change of the amount of air supplied to the burner. In short, it becomes unnecessary to additionally consider the change of the amount of air injected from through the dilution air port means derived from the measurement of the heating value of fuel and/or the humidity of combustion air.

According to the present invention, by performing the fuel lean premixed combustion in which excess air and fuel are mixed beforehand prior to combustion, it becomes possible to perform the combustion in the fuel lean condition within the whole flame, thereby reducing NOx. Further, in such fuel lean premixed combustion mode, the reaction zone of the combustion can be made smaller, thereby performing a high load combustion with a short flame.

DETAILED DESCRIPTION OF PREFERRED EMBODIMENTS

Figure 1:
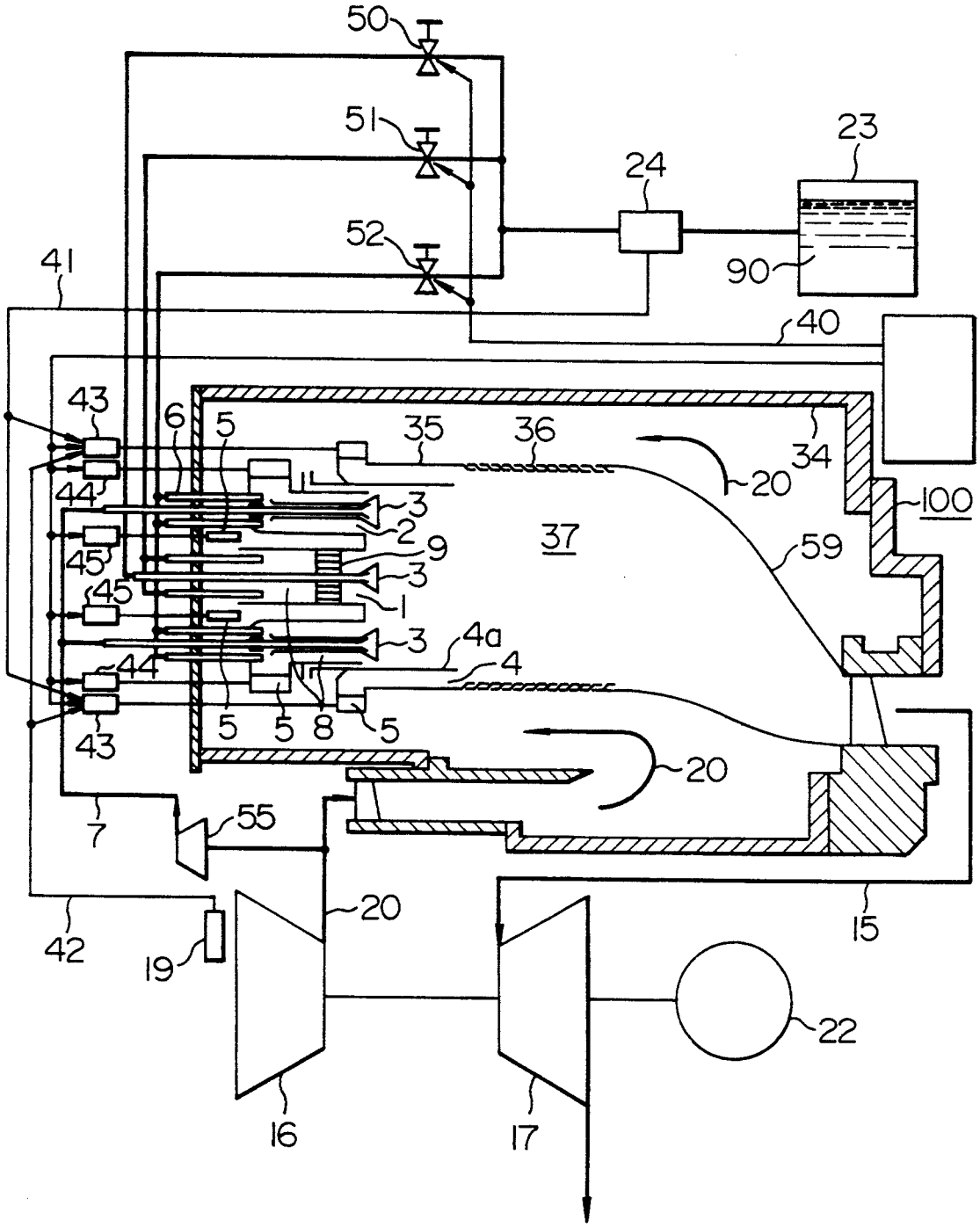
FIG. 1 is a view of a gas turbine generating apparatus according to an embodiment of the present invention.

Referring to FIG. 1, a combustor 100 comprises a combustor casing 34, an inner housing 35, a pilot burner 1 serving as a primary stage combustion burner, a main burner 2 serving as a secondary stage combustion burner, a dilution or bypass air port 4.

The combustion air 20 flows into the combustor 100 after being compressed by an air compressor 16. The combustion air 20 flows through a space between the combustor casing 34 and the inner housing 35 into a mixing chamber 8 and is then jetted into a combustion chamber 37 through the pilot burner 1 and the main burner 2. A part of the combustion air 20 is jetted into the combustion chamber 37 through the bypass air port 4 and cooling air ports 36. Combustion gas 15 produced in the combustion chamber 37 is introduced through a transition piece 59 into a turbine 17 so as to drive it and an electric generator 22 connected to the turbine 17.

The pilot burner 1 is provided in the vicinity of a central axis of the combustion chamber 37 and the ring-shaped main burner 2 is provided around the pilot burner 1. Baffles 3 are provided at the ends of exhaust ports of the pilot burner 1 and the main burner 2. It is preferable that each baffle 3 has a hollow structure so as to allow cooling fluid to be supplied into the inside thereof. In the combustor shown in FIG. 1, the baffle 3, provided on the main burner 2, is cooled with compressed air 7. A part of the combustion air 20 is extracted therefrom and further compressed by a small compressor 55 and led to the baffle 3 as the cooling air 7. After cooling the baffle 3, cooling air 7 is released into the mixing chamber 8. To the contrary, fuel is supplied to the inside of the baffle 3 provided on the pilot burner 1 so as to cool the same.

Fuel is jetted through fuel nozzles 6 into the mixing chambers 8 provided for the pilot burner 1 and the main burner 2, respectively. A part of fuel supplied to the pilot burner 1 is jetted from the side or the center of the baffle 3. For this reason, it is possible to make the fuel concentration in the vicinity of the baffle 3 in the pilot burner 1 higher than that in the surroundings. Consequently, a diffusion flame is formed locally so as to improve the flame stability. Accordingly, at the time of ignition, cross fire and the like when the flame is easily blown off, it is preferable to eject the fuel from the side or the center of the baffle 3.

The pilot burner 1 and the main burner 2 are disposed substantially on the same plane. This makes it easy to perform the cross fire from a pilot flame to a main flame. It is preferable that the bypass air port 4 is disposed downstream of the end of exhaust port of the main burner 2. To this end, it is preferable to extend a bypass air guide **4*a* beyond the main burner 2. In consequence, it becomes possible to prevent the main flame from being blown off by the bypass air stream. Moreover, it is desirable that the bypass air guide 4*a* is protected from the heating by the flame by making a part of the combustion air 20 flow along the bypass air guide 4*a*** to cool the same.

The mixing chamber 8 for each burner and the bypass air port 4 are provided at the inlet port thereof with swirler vanes 5, a pitching angle of each of which is changeable. By changing the pitching angle, it is possible to change the areas of the inlet ports of the burners and the bypass air port, respectively, so that the amount of air flowing into each burner and the amount of bypass air are controlled. Moreover, as the pitching angle is changed, not only the air flow rate but also the swirl strength is also changed. However, since each burner is provided with the baffle 3, the flame can be stabilized without being influenced by the swirl strength. Further, when it is not desired to give a strong swirl to the flow, it is preferable to insert a honeycomb 9 or the like into the mixing chamber 8 to weaken the swirl strength. It is desirable that the bypass air port 4 is so disposed as to extend in parallel with the flow of air in the pilot burner 1 or the main burner 2. By so doing, the flow resistance of the air through the passage can be lowered so that the efficiency of the gas turbine can be increased.

Fuel 90 is supplied from a fuel tank 23, after its heating value is measured by a fuel heating value measuring device 24, to the combustor through a pilot diffusion fuel flow rate control device 50, a pilot premixed fuel flow rate control device 51 and a main fuel flow rate control device 52. In each fuel flow rate control device, the fuel flow rate and the fuel distribution ratio are decided in accordance with a gas turbine load signal 40.

The humidity of the combustion air 20 is measured by a humidity measuring device 19. It is further compressed by the air compressor 16 and then introduced into the combustor. The amounts of air flowing into the pilot burner, the main burner and the bypass air port can be controlled, respectively, by changing the pitching angles of the swirler vanes 5. The pitching angles (opening degrees) of the swirler vanes 5 are determined by a pilot air flow rate control device 45, a main air flow rate control device 44 and a bypass air flow rate control device 43, respectively, in accordance with the gas turbine load signal 40, an air humidity signal 42, and a fuel heating value signal 41. The pitching angle (opening degree) of the swirler vanes 5 for controlling the pilot air flow rate and the pitching angle (opening degree) of the swirler vanes 5 for controlling the main air flow rate are determined in accordance with the gas turbine load signal 40. The pitching angle (opening degree) of the swirler vanes 5 for controlling the bypass air flow rate is determined in accordance with the gas turbine load signal 40, the air humidity signal 42 and the fuel heating value signal 41.

Figure 2:
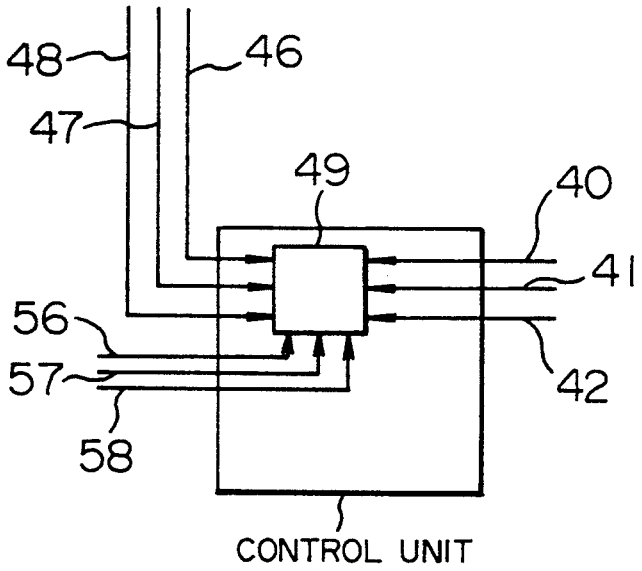
FIG. 2 is a view illustrating input-output signals of a control unit the apparatus of FIG. 1.

A signal 46 indicative of the pitching angle (opening degree) of the swirler vanes 5 for controlling the pilot air flow rate, a signal 47 indicative of the pitching angle (opening degree) of the swirler vanes 5 for controlling the main air flow rate and a signal 48 indicative of the pitching angle (opening degree) of the swirler vanes 5 for controlling the bypass air flow rate are sent to a control unit where the pitching angles (opening degrees) of the respective swirler vanes 5 or the distribution ratio between the pilot air flow rate, the main air flow rate and the bypass air flow rate are indicated on a display 49 (See FIG. 2). Further, the gas turbine load signal 40, the air humidity signal 42, the fuel heating value signal 41, a pilot diffusion fuel flow rate signal 56, a pilot premixed fuel flow rate signal 57 and a main fuel flow rate signal 58 are also sent to the control unit to be indicated on the display 49.

Figure 3:
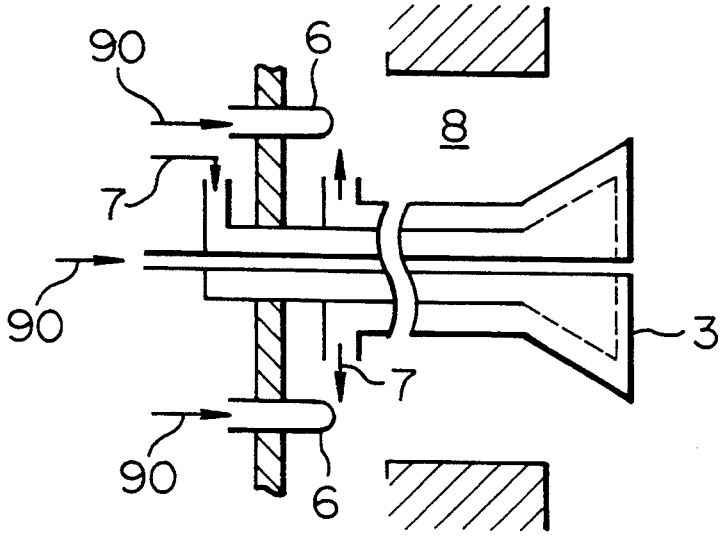
FIG. 3 is a view illustrating a flame holder provided on a burner of a combustor.

In FIG. 3, the baffle 3 is cooled by the compressed air 7. The baffle 3 is of a double hollow structure in which cooling is effected by making the compressed air 7 collide against the inner surface of the baffle 3 at high speed. The air used for cooling is preferably released into the mixing chamber 8. If the air used for cooling is released from the side, the forward end or the center of the baffle, the flame is blown off by the cooling air. Incidentally, the fuel 90 is emitted from the central portion of the baffle 3 in order to locally form a fuel rich zone in the vicinity of the baffle 3.

Figure 4:
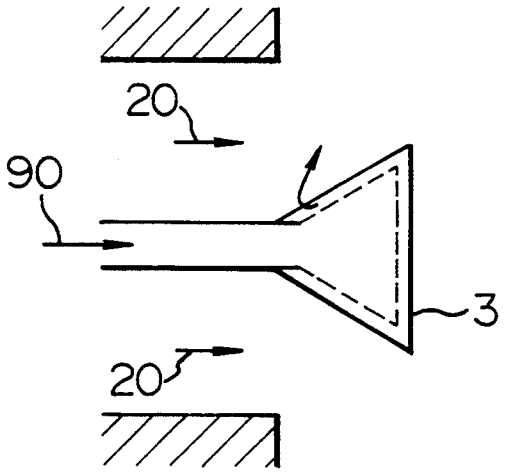
FIG. 4 is a view illustrating another flame holder of the combustor.

The baffle 3 shown in FIG. 4 is cooled by making the fuel 90 collide against the inner surface of the baffle 3. This type of baffle is suitable for the pilot burner. The fuel 90 is released from the side of the baffle 3. By releasing the fuel in this way, a fuel rich zone is locally formed in the vicinity of the baffle 3 so that the stability of the flame is improved.

Figure 5:
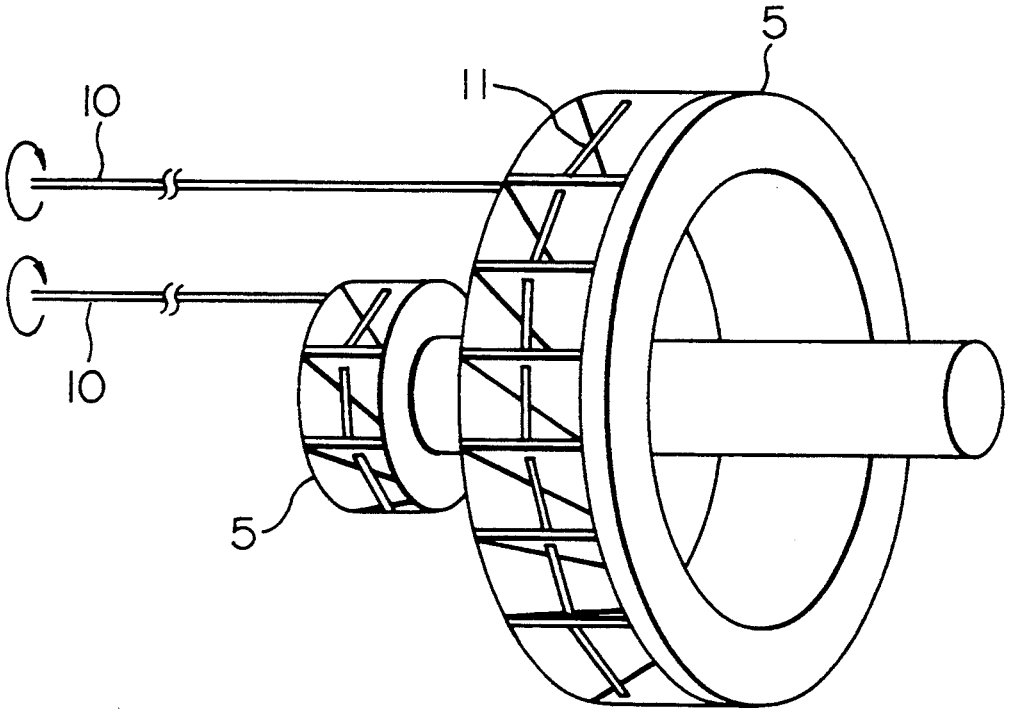
FIG. 5 is a view illustrating an air flow rate control mechanism of the combustor.

The air flow rate control mechanism of the combustor shown in FIG. 1 will be explained in detail hereinafter with reference to FIG. 5. The pitching angle of the swirler vane 5 can be changed by a rotary shaft 10. Since the swirler vanes 5 are connected with each other through connecting rods 11, the pitching angles of the swirler vanes 5 are simultaneously changed. It is noted that the small diameter swirler vanes 5 are for the pilot burner while the large diameter swirler vanes are for the main burner.

Figure 6:
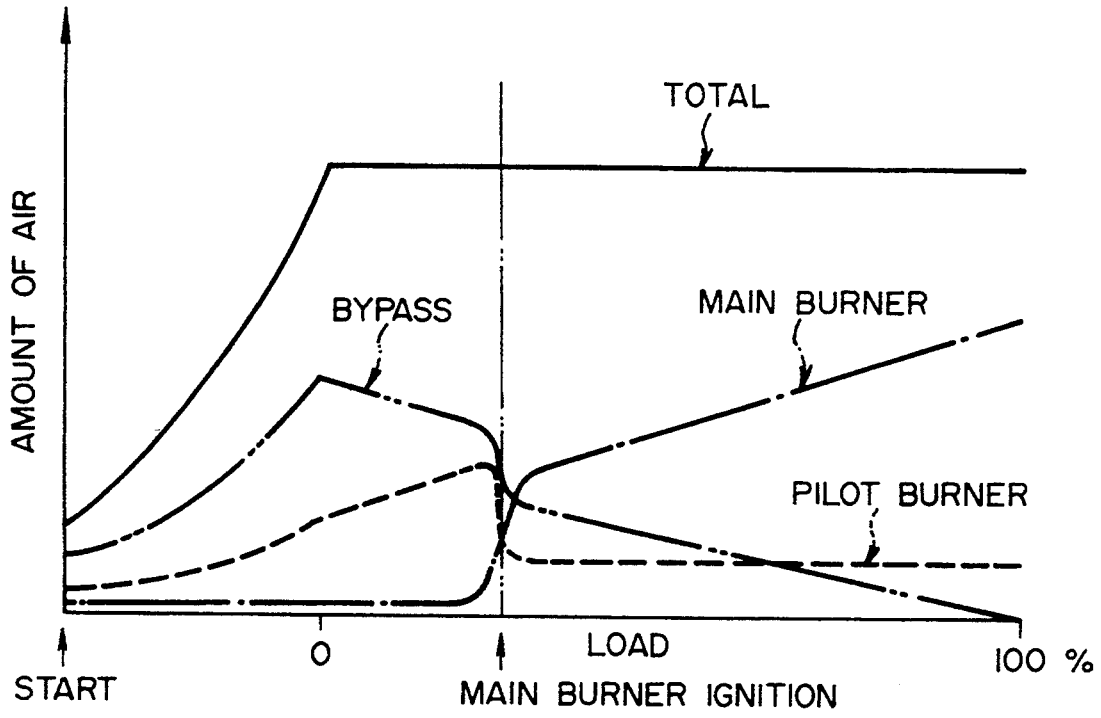
FIG. 6 is a graph showing the relationship between gas turbine load and air flow rate in the combustor of FIG. 1.

Referring to FIG. 6, when the gas turbine is started, the amount of bypass air becomes larger while the amount of main air becomes smaller. The amount of pilot air is regulated so as to be close to the equivalent fuel-air ratio at which the stability of the pilot flame is the highest. As the turbine speed is increased, the total air flow rate is also increased. In this case, the flow rate of the bypass air, the main air and the pilot air is substantially constant.

When the gas turbine load is between 0% and 100%, the amount of air supplied to the combustor is substantially constant. Between 0% load and the main flame ignition, the amount of bypass air is decreased while the pilot air flow rate is increased as the load is increased. When the main flame is ignited, the amount of main air is increased and the amount of bypass air is correspondingly decreased. After the main flame is ignited, until 100% load, the amount of main air is increased while the amount of bypass air is decreased in accordance with the increase of the load. After the amount of pilot air is once reduced it is kept substantially constant. When the load is 100%, the amount of bypass air is nearly 0 (zero). Therefore, when the load is 100%, it is possible to use almost all of air flowing into the combustor as the combustion air except the air required at a minimum for cooling the combustor. Consequently, a premixed combustion can be performed in the condition that the fuel concentration is sufficiently lean, thereby making it possible to reduce NOx emission. By preparing the program in which the diagrams shown in FIG. 6 are stored, and controlling the air flow rates of the burners and the bypass air flow rate in accordance with this program, it becomes possible to automatically perform the air flow rate control in response to the gas turbine load.

Figure 7:
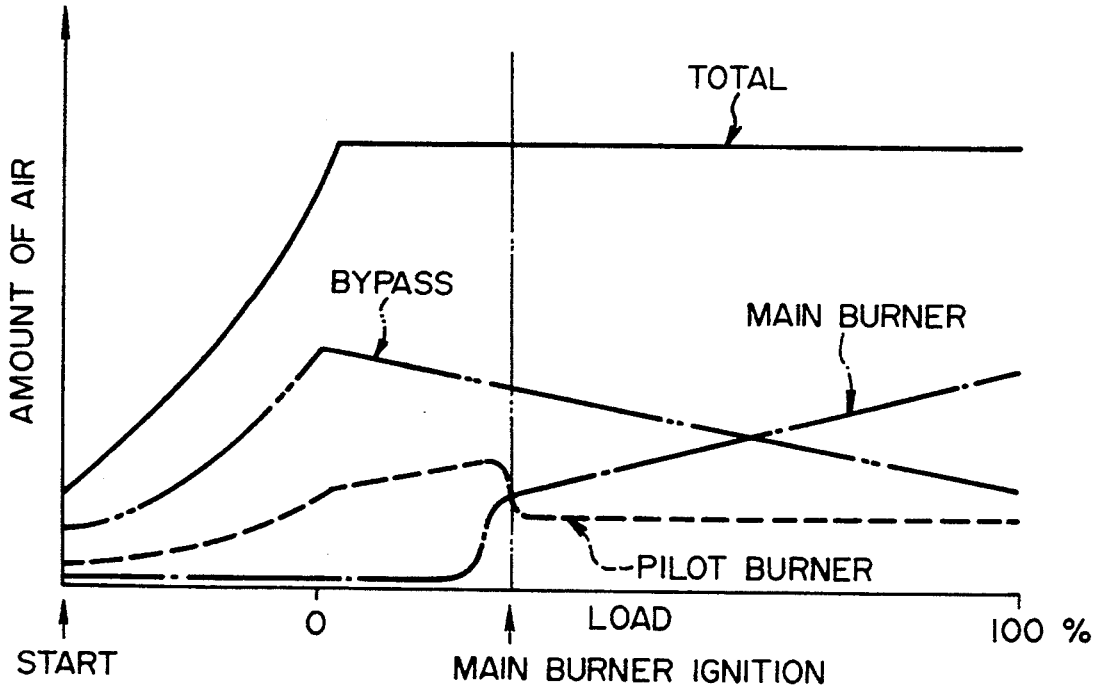
FIG. 7 PRIOR ART
FIG. 7 is a graph showing the relationship between gas turbine load and air flow rate in a conventional combustor.

When a conventional combustor which has a mechanism for controlling the amount of main air and the amount of pilot air but does not have a mechanism for controlling the amount of bypass air is operated, as shown in FIG. 7, although the amount of main air and the amount of pilot air can be changed in response to the load, a part of air is released as the bypass air even when the load is 100% since no bypass air amount control mechanism is provided. As a result, this combustor runs short of combustion air particularly at the high load operation as compared with the combustor of the present invention. Namely, since the premixed combustion cannot be performed in the condition that the fuel concentration is sufficiently lean, the NOx emission is increased.

Figure 8:
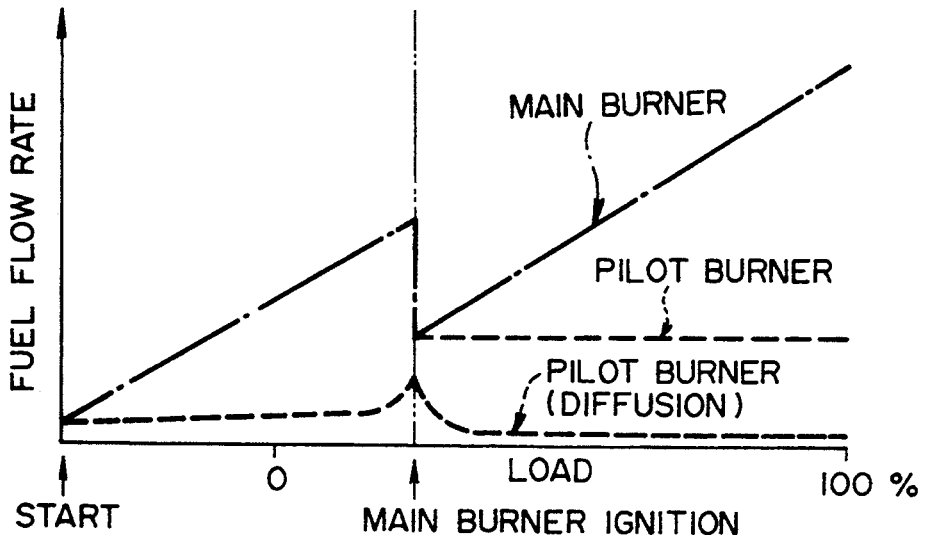
FIG. 8 is a graph showing the relationship between gas turbine load and fuel flow rate when the combustor of FIG. 1 is operated.

Referring to FIG. 8, when the load of the gas turbine is low, only the pilot burner fuel is injected, and the amount of pilot fuel is increased as the load is increased. Further, the diffusion combustion ratio of the pilot flame is increased at the time of starting when the flame is easily blown off, and it is gradually reduced as the load is increased. When the main flame is ignited, the amount of pilot burner fuel is reduced to about ½ and the main burner fuel is supplied in an amount equal to the reduced amount of pilot burner fuel. After the main flame is ignited, the amount of main burner fuel is increased as the load is increased with the amount of pilot fuel kept substantially constant. Further, after the main flame is ignited, the diffusion combustion ratio of the pilot flame is minimized or the pilot flame is entirely turned into the premixed flame as well.

Figure 9:
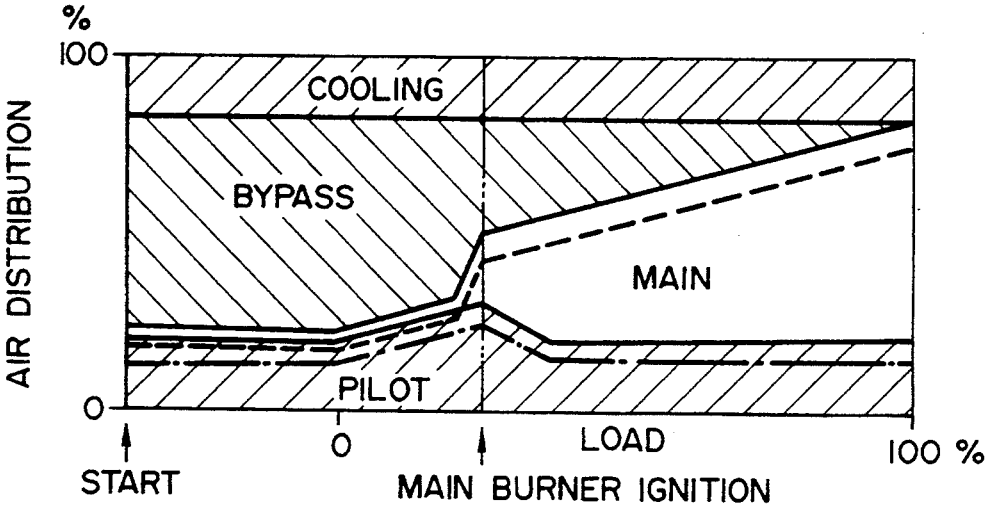
FIG. 9 is a graph showing the relationship between gas turbine load and air distribution ratio when the combustor of FIG. 1 is operated.

The relationship between the gas turbine load and the air distribution ratio will be described hereinafter with referring to FIG. 9. In the combustor of the present invention, since it is possible to control the amount of bypass air independently, when the gas turbine load is low, the excess air ratios of the pilot flame and the main flame can be held in the stably combustible range by mostly bypassing the air, while, when the gas turbine load is high, almost all of air can be used as the combustion air except the air required at a minimum for the cooling, with the result being that the premixed flame combustion can be performed in a condition close to the lean limit of inflammability, thereby lowering the NOx density.

Further, the NOx emission density is influenced considerably by the humidity of air and the heating value of the fuel. In general, when the humidity of air is high or when the heating value of the fuel is low, the NOx emission density becomes lower but the flame stability is reduced to easily cause a flame blow off. In the combustor of the present invention, when the humidity of air is high or when the heating value of the fuel is low, the amount of bypass air is increased more than usual so that the amount of main air and the amount of pilot air are reduced as shown by the broken line and the one-dot chain line, respectively, in FIG. 9, thereby making it possible to prevent the flame blow off. On the other hand, when the humidity of air is low or when the heating value of the fuel is high, the amount of bypass air is reduced less than usual so that the amount of main air and the amount of pilot air are increased respectively as shown by the solid line in FIG. 9, thereby making it possible to reduce the NOx emission.

Figure 10:
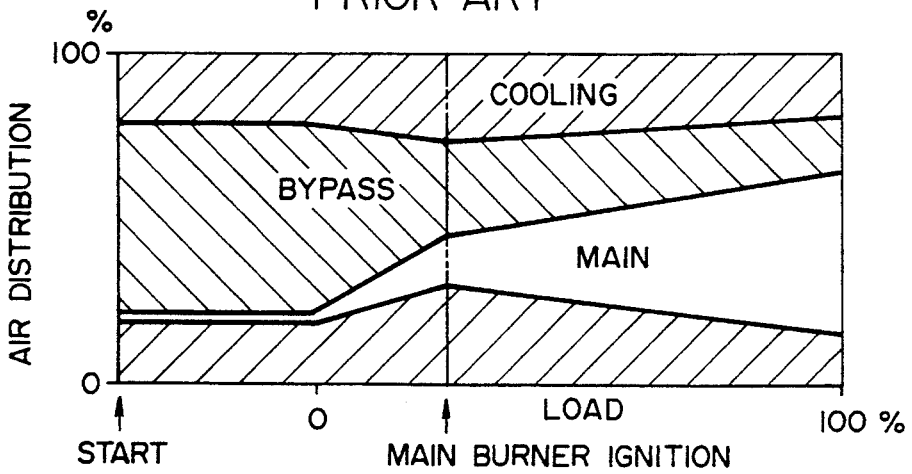
FIG. 10 PRIOR ART
FIG. 10 is a graph showing the relationship between gas turbine load and air distribution ratio when the conventional combustor is operated.

To the contrary, with referring to FIG. 10, the explanation will be made to the relation between the gas turbine load and the air distribution ratio when the conventional combustor is operated, which is capable of controlling the amount of pilot air but not provided with the mechanism for controlling the amount of bypass air independently. In this case, since the bypass air port cannot be closed, a part of air is allowed to bypass even when the gas turbine load is high. Therefore, the premixed flame combustion cannot be performed in a condition that the fuel is sufficiently lean. Further, it is impossible to control the amount of bypass air in accordance with the humidity of air and the heating value of the fuel.

Figure 11:
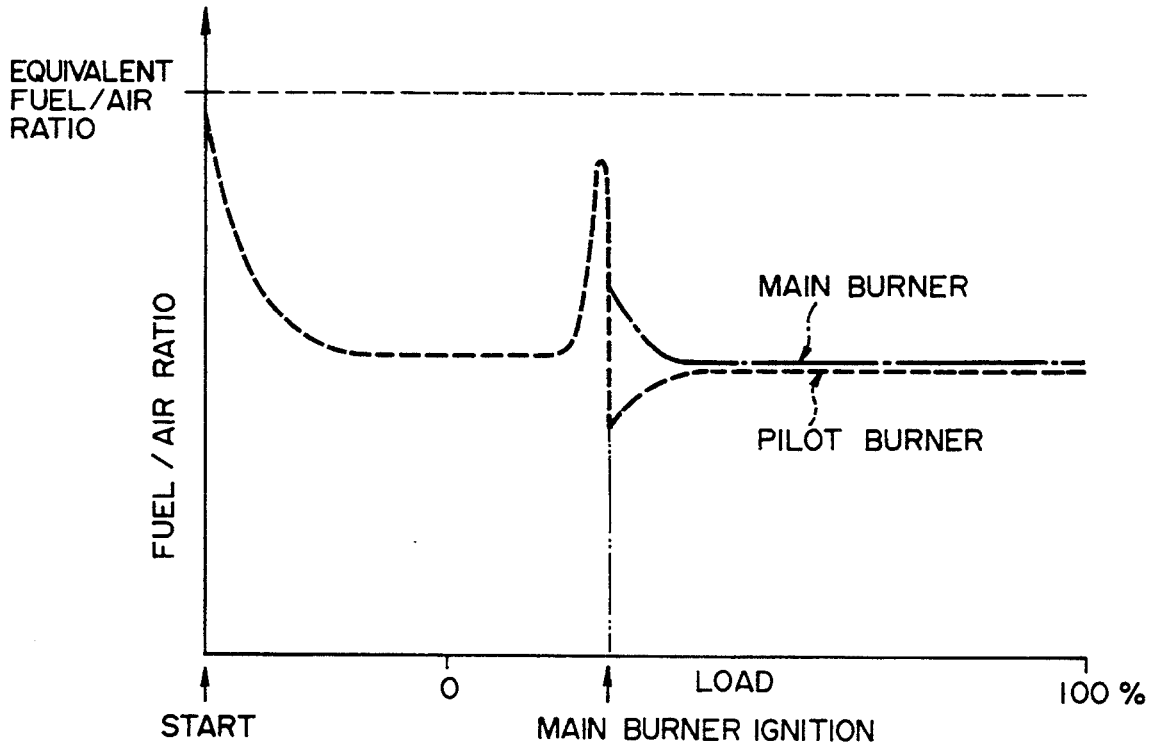
FIG. 11 is a graph showing the relationship between gas turbine load and fuel concentration (fuel/air ratio) of each burner when the combustor of FIG. 1 is operated.

The relation between the gas turbine load and the fuel densities (fuel/air ratios) of the pilot flame and the main flame when the combustor of the present invention is operated will be described hereinafter with referring to FIG. 11. After the pilot flame is ignited nearly at the equivalent fuel-air ratio, the fuel/air ratio (fuel flow rate/air flow rate) is gradually decreased. During an operation of the gas turbine (0% load–100% load), the air flow rates are so controlled that the fuel densities (fuel/air ratios) of the pilot flame and the main flame are kept in the lean fuel condition in which the NOx emission density becomes low. Therefore, the NOx emission density is low over the almost whole operation load range. However, when the main flame is ignited, it is necessary to set the fuel concentration of the pilot flame nearly at the equivalent fuel-air ratio. The reason is that, since it is necessary to change over the fuel supply from the pilot flame to the main flame, the pilot flame must be prevented from being blown off at this time. For this reason, the NOx emission density becomes easily higher temporarily when the main flame is ignited.

In order to decrease the NOx emission density when the main flame is ignited, it is preferable that the pilot burner and the main burner are disposed substantially on the same plane as shown in FIG. 1. By disposing the pilot burner and the main burner in this manner, even if the fuel concentration (fuel/air ratio) of the pilot flame is nearly at the equivalent fuel-air ratio, the fuel contained in the pilot flame is rarefied with air jetted through the main burner, thereby reducing the NOx emission density.

Figure 12:
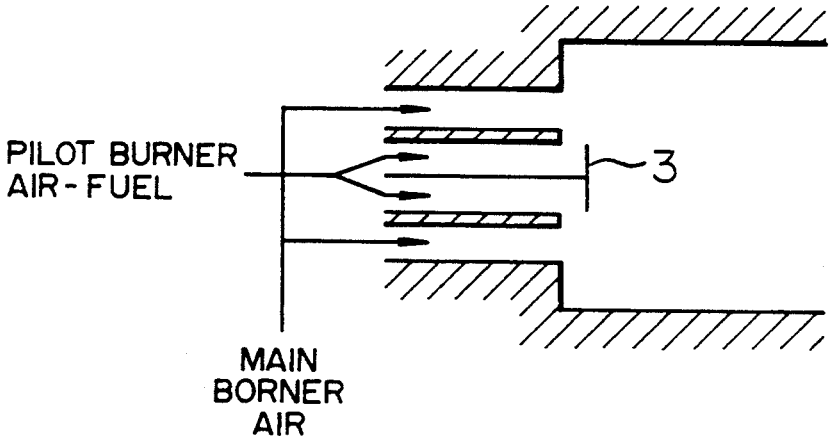
FIG. 12 is a sectional view of a combustor used for inspecting the NOx reducing effect at the time of changing fuel.
Figure 13:
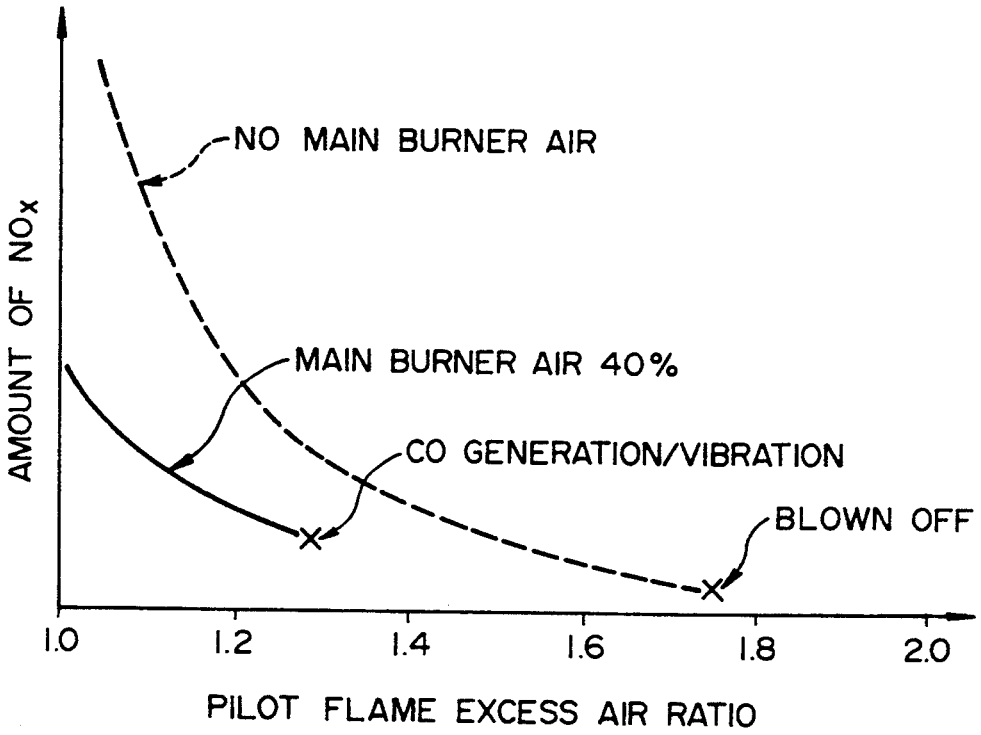
FIG. 13 is a graph showing the NOx reducing effect at the time of changing fuel when the combustor of FIG. 12 is applied.

As shown in FIG. 12, a pilot flame is formed in the combustion apparatus in which the baffle 3 is disposed at a center of the apparatus, and then the NOx emission density is measured when the main air flows and when no main air flows. As shown in FIG. 13, when the amount flows around the pilot flame, an amount of which occupies about 40% of the total amount of air, the NOx emission density is relatively low even if the fuel concentration of the pilot flame is close to the equivalent fuel-air ratio (the excess air ratio being 1.0). The reason is that the pilot fuel is rarefied with the main air before combustion.

Figure 14:
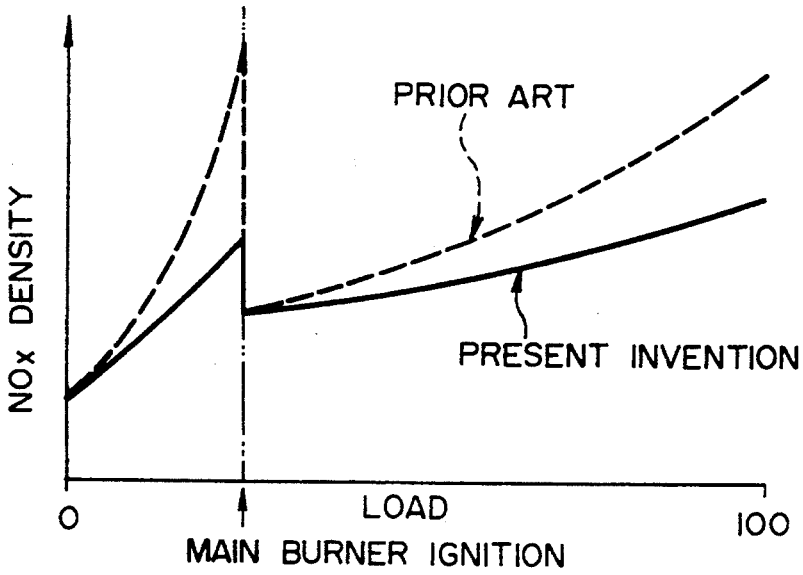
FIG. 14 is a graph showing the relationship between gas turbine load and NOx emission density when the combustor of the present invention is applied.

The relation between the gas turbine load and the NOx emission density when the gas turbine combustor of the present invention is operated will be described hereinafter with referring to FIG. 14. In the combustor of the present invention, the NOx emission density becomes lower over the whole load range as compared with the conventional combustor. Particularly, in the conventional combustor, at the time of fuel supply changing when the main flame is ignited, since the excess air ratio of the pilot flame approaches the equivalent air-fuel ratio, the NOx emission density is easily increased temporarily. However, in the combustor of the present invention, since the fuel contained in the pilot flame is reduced with the air jetted through the main burner in that time, the NOx emission density is reduced. Further, since it is possible to control the amount of bypass air independently, almost all of air can be used as the combustion air when the load is 100%, and therefore, it is possible to perform the premixed flame combustion in the condition that the fuel concentration is lean, thereby reducing the NOx density. In addition, even if the humidity of air and the heating value of the fuel are changed, it is possible by controlling the amount of bypass air to prevent the blow off and to lower the NOx emission density constantly.

Figure 15:
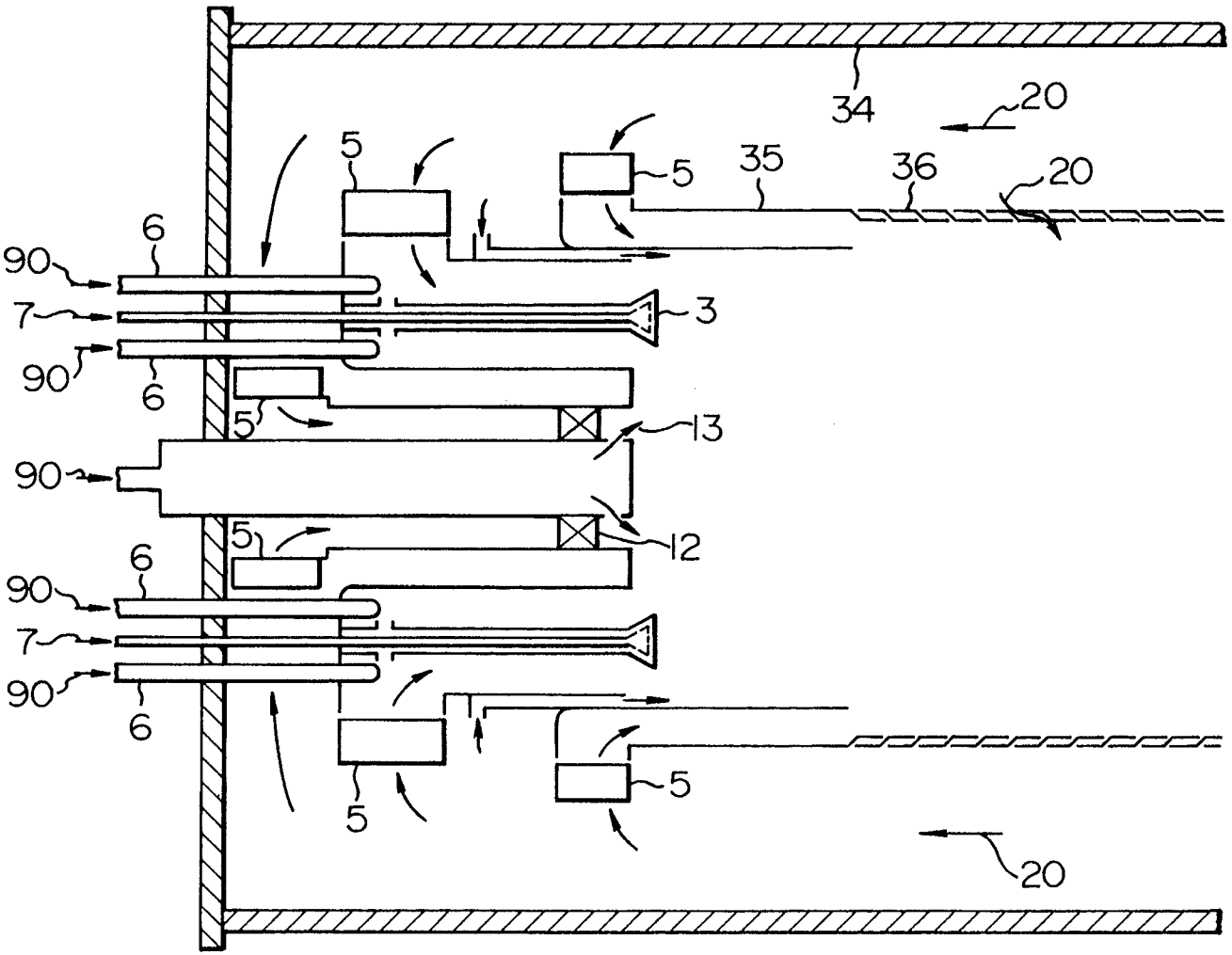
FIG. 15 is a sectional view of a combustor according to another embodiment of the present invention.

As shown in FIG. 15, in a modification of the combustor according to the present invention, a central pilot burner is a diffusion combustion burner. A swirler 12 is provided in the vicinity of the outlet port of the pilot burner so as to stabilize the pilot flame by the action of the swirl flow. In this combustor as well, the swirler vanes 5 are provided on the pilot burner, the main burner and the bypass air port, respectively, the pitch angles of which vanes 5 are changeable.

Figure 16:
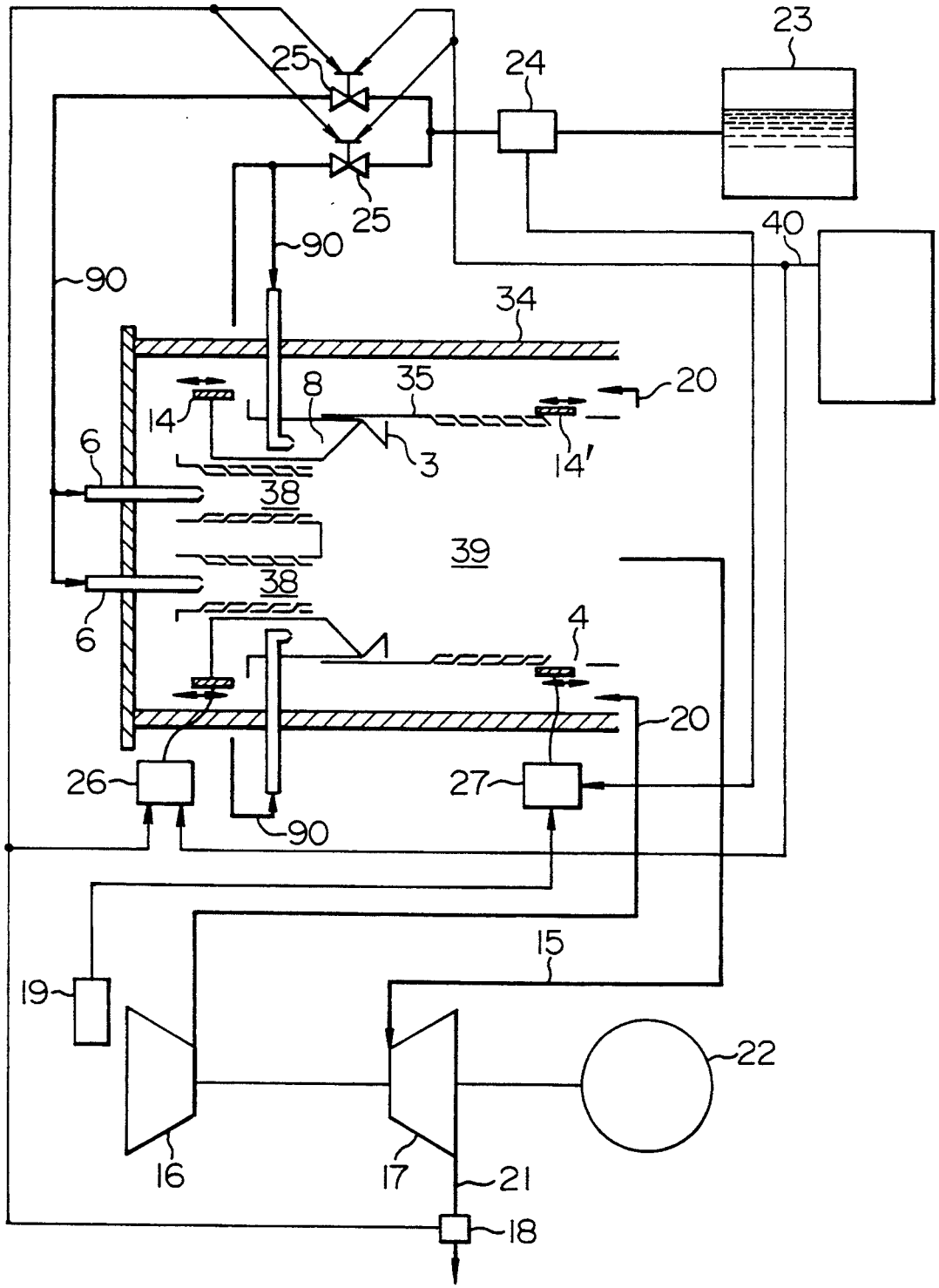
FIG. 16 is a view of a gas turbine generating apparatus according to another embodiment of the present invention.

In another gas turbine generating apparatus of a combustor of the present invention, as shown in FIG. 16, the combustion air 20 is compressed by the air compressor 16 after measuring the humidity thereof by the humidity measuring device 19 and it is supplied to the combustor. The combustion air 20 flows between the combustion casing 34 and the inner housing 35 and is then jetted into a primary combustion chamber 38 and a secondary combustion chamber 39. The combustion gas 15 produced in the combustion chamber is introduced into the turbine 17 through a transition piece (not shown) so as to drive the turbine 17 and the electric generator 22 connected to the turbine 17. After driving the turbine 17, the NOx density of the exhaust gas 21 is measured by an NOx density measuring device 18 and is then released.

The fuel is supplied from the fuel tank 23 to the combustor through the fuel flow rate control device 25 after the measurement of the heating value thereof by the fuel heating value measuring device 24. In the fuel flow rate control device 25, the fuel flow rate and the fuel distribution ratio are determined in accordance with the gas turbine load signal and the NOx density signal from the NOx density measuring device 18.

The combustor is divided into the primary combustion chamber 38 and the secondary combustion chamber in the direction of the flow. Into the primary combustion chamber 38, the fuel 90 is directly jetted so as to effect the diffusion combustion. On the other hand, into the secondary combustion chamber supplied is a mixture into which the fuel 90 is mixed with air in the mixing chamber 8, so as to effect the premixed combustion. A premixed flame formed in the secondary combustion chamber can be held by means of the baffle 3. The amount of air supplied into the secondary combustion chamber and the amount of bypass air released from the bypass air port 4 are independently regulated by the respective slide rings 14 and 14'. The opening degrees of the slide rings are determined by a combustion air amount control device 26 and a bypass air amount control device 27, respectively.

The combustion air amount control device 26 determines the opening degree of the slide ring 14 in accordance with the gas turbine load signal and the NOx density signal from the NOx density measuring device 18 so as to control the amount of air supplied into the secondary combustion chamber. The bypass air amount control device 27 determines the opening degree of the slide ring 14' in accordance with the air humidity signal and the fuel heating value signal so as to control the amount of bypass air.

According to the present invention, it is possible to provide the gas turbine combustor which is capable of reducing the NOx density over the whole operation load range. Further, it is possible to provide the gas turbine combustor which is capable of reducing the NOx density without causing any blow off of the flame even if the humidity of air or the heating value of fuel is changed. Consequence, it is possible to provide the gas turbine combustor which is less influenced by the seasons in terms of the NOx density.

By applying the gas turbine combustor of the present invention to the gas turbine generating installations, it is possible to reduce the amount of ammonia which is to be used in the DeNOx plant equipped in the generating installations.

What is claimed is:

1. A gas turbine combustor comprising:

a combustion chamber;

pilot burner means of a premixed flame burner type disposed in said combustion chamber, said premixed flame burner means being constructed such that fuel and air are premixed prior to combustion;

main burner means of a premixed flame burner type disposed so as to surround said pilot burner means, said main burner means being constructed such that fuel and air are premixed prior to combustion;

bypass air port means;

means for supplying fuel to said pilot burner means and said main burner means;

first means for controlling an amount of fuel to be supplied to said pilot burner means;

second means for controlling an amount of fuel to be supplied to said main burner means, said second fuel controlling means being independent of said first fuel controlling means;

means for supplying air to said pilot burner means, said main burner means and said bypass air port means;

first means for controlling an amount of air to be supplied to said pilot burner means;

second means for controlling an amount of air to be supplied to said main burner means;

third means for controlling a flow rate of air to be supplied to said bypass air port means, said first, second and third air controlling means being independent from one another;

means for sensing a fuel heating value of fuel to be supplied to said combustion chamber;

means for sensing a humidity of air to be supplied to said combustion chamber;

means for detecting a load of the gas turbine;

means for determining respective control variables of said first and second fuel controlling means based upon a detected gas turbine load in such a manner that, when the detected gas turbine load is under a load which requires a main burner ignition, the detected gas turbine load is increasing, and the controlled variable of the first fuel controlling means is determined so as to increase an amount of fuel to be supplied to said pilot burner means and, when the detected gas turbine load is equal to or greater than a load requiring a main burner ignition, when the detected gas turbine load is increasing, the controlled variable of the second fuel controlling means is determined so as to increase the amount of fuel to be supplied to said main burner means;

means for determining respective controlled variables of said first and second air controlling means based upon detected gas turbine load in such a manner that, when the detected gas turbine load is under a load requiring a main burner ignition, the controlled variable of said first air controlling means is determined so as to increase an amount of air to be supplied to said pilot burner means, and when the detected gas turbine load in a vicinity of requiring a main burner ignition, the controlled variable of the first air controlling means is determined so as to decrease an amount of air to be supplied to the pilot burner means, and when the detected gas turbine load is greater than a load which requires a main burner ignition, the controlled variable of said second air controlling means is determined so as to increase an amount of air to be supplied to said main burner means;

means for determining the controlled variable of the third air controlling means in dependence upon a detected fuel heating value and a detected air humidity in such a manner that, when the detected fuel heating value is greater than a reference level, the controlled variable of said third air controlling means is determined so as to decrease a flow rate of air to be supplied from said dilution air port means, when the detected fuel heating value is less than the reference level, the controlled variable of said third air controlling means is determined so as to increase a flow rate of air to be supplied from the dilution air port means, when the detected air humidity is greater than a reference level, the controlled variable of said third air controlling means is so determined so as to increase a flow rate of air to be supplied from said dilution air port means, and when the detected air humidity is less than the reference level, the controlled variable of said third air controlling means is determined so as to decrease a flow rate of air to be supplied from said dilution air port means; and means for determining the controlled variable of said third air controlling means in dependence upon a detected gas turbine load in such a manner that, when the detected gas turbine load is increasing, the controlled variable of said third air controlling means is determined so as to decrease a flow rate of air to be supplied from said dilution air port means, and a ratio of a change of the flow rate of air to be supplied from said dilution air port means to said change of the detected gas turbine load being maximum when a detected gas turbine load is substantially a load which requires a main burner ignition.

2. A gas turbine combustor according to claim 1, wherein forward end portions of said pilot and main burner means are positioned substantially on the same plane.

3. A gas turbine combustor according to claim 1, wherein said first and second means for controlling air each include an air swirl type structure including controllable pitch swirler vanes, and wherein an angle of said vanes is adapted to be changed to regulate an air flow rate.

4. A gas turbine combustor according to claim 1, further comprising:

flame holding means provided in the respective pilot and main burner means, including a baffle against which a jet of mixture of fuel and air collides.

5. A gas turbine combustor according to claim 1 further comprising:

a compressor for compressing air to be introduced into said combustor; and an electric generator driven by a power obtained from said turbine.

6. A combustor for a gas turbine according to claim 1, further comprising:

a compressor for compressing air to be introduced into said combustor;

a turbine driven by combustion gas produced in said combustor;

an electric generator driven by a power obtained by said turbine;

a display for indicating the respective controlled variables.

* * * * *